US008888273B2

(12) United States Patent
Kitagishi

(10) Patent No.: US 8,888,273 B2
(45) Date of Patent: Nov. 18, 2014

(54) LIQUID EJECTING APPARATUS

(71) Applicant: Seiko Epson Corporation, Tokyo (JP)

(72) Inventor: Mikio Kitagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/748,464

(22) Filed: Jan. 23, 2013

(65) Prior Publication Data

US 2013/0188000 A1 Jul. 25, 2013

(30) Foreign Application Priority Data

Jan. 25, 2012 (JP) ..... 2012-013070

(51) Int. Cl.
*B41J 11/00* (2006.01)

(52) U.S. Cl.
CPC ..... *B41J 11/0085* (2013.01)
USPC ..... 347/104

(58) Field of Classification Search
CPC ..... B41J 11/00; B41J 11/0085
USPC ..... 347/101, 104
See application file for complete search history.

(56) References Cited

U.S. PATENT DOCUMENTS

| | | | | |
|---|---|---|---|---|
| 6,038,776 | A | 3/2000 | Yamada et al. | |
| 6,270,215 | B1 | 8/2001 | Miyasaka et al. | |
| 6,454,259 | B1 * | 9/2002 | Madsen et al. | 271/276 |
| 6,497,522 | B2 * | 12/2002 | Wotton et al. | 400/578 |
| 6,554,514 | B2 * | 4/2003 | Wotton et al. | 400/648 |
| 6,682,238 | B2 * | 1/2004 | Yraceburu et al. | 400/635 |
| 8,398,200 | B2 * | 3/2013 | Higuchi | 347/16 |
| 2001/0028380 | A1 * | 10/2001 | Wotton et al. | 347/102 |
| 2001/0046404 | A1 * | 11/2001 | Wotton et al. | 400/578 |
| 2002/0031389 | A1 * | 3/2002 | Wotton et al. | 400/648 |
| 2002/0167578 | A1 * | 11/2002 | Miki et al. | 347/104 |
| 2011/0285799 | A1 * | 11/2011 | Okura et al. | 347/102 |
| 2013/0016167 | A1 * | 1/2013 | Kitagishi et al. | 347/102 |
| 2013/0021417 | A1 * | 1/2013 | Ota et al. | 347/85 |

FOREIGN PATENT DOCUMENTS

| | | | |
|---|---|---|---|
| JP | 05-138961 | A | 6/1993 |
| JP | 06-015902 | A | 1/1994 |
| JP | 10-035186 | A | 2/1998 |
| JP | 11-208045 | A | 8/1999 |
| JP | 2000-246983 | A | 9/2000 |
| JP | 2000-296941 | A | 10/2000 |
| JP | 2004-090538 | A | 3/2004 |

* cited by examiner

*Primary Examiner* — Huan Tran

(74) *Attorney, Agent, or Firm* — Maschoff Brennan

(57) ABSTRACT

The liquid ejecting apparatus includes a transport unit that transports a medium, an ink jet head that ejects ink onto the medium, and a recording-medium support unit having a support surface on which the medium is supported. The support surface has suction holes, which are located outside a print area in which the ink is ejected.

5 Claims, 4 Drawing Sheets

LIQUID EJECTING APPARATUS

BACKGROUND

1. Technical Field

The present invention relates to liquid ejecting apparatuses.

2. Related Art

JP-A-2000-246983 discloses an ink jet printer, which is an example of a liquid ejecting apparatus. The ink jet printer disclosed in JP-A-2000-246983 includes a platen for placing a recording medium in an image forming area where an image is formed. The platen has a plurality of air suction holes, and an image is formed on the recording medium while air is sucked from the air suction holes to attract a portion of the recording medium located in the image forming area to the platen.

With the above technique, even if curled roll paper is used as a recording medium, the paper is brought into tight contact with the platen due to the air suction holes and is prevented from floating. Accordingly, it is possible to maintain a constant distance between the roll paper and an ink jet head in the image forming area, and hence, to improve the image quality.

However, if the suction holes are provided in the image forming area in the platen, a difference in temperature is observed in a recording medium, between portions in contact with the platen and portions not in contact with the platen (i.e., portions above the suction holes, i.e., spaces). This may vary the evaporation rate of ink solvent landed on the recording medium in the image forming area and result in an uneven image.

SUMMARY

An advantage of some aspects of the invention is that it provides a liquid ejecting apparatus that can prevent floating of a recording medium to minimize generation of an uneven image. A liquid ejecting apparatus includes a transport unit that transports a recording medium; a liquid ejecting head that ejects liquid onto the recording medium; and a recording-medium support unit having a support surface on which the recording medium is supported, the support surface having a plurality of suction holes. The plurality of suction holes in the support surface are located outside a liquid ejecting area in which the liquid is ejected.

With this configuration, that is, by bringing the recording medium into tight contact with the support surface by utilizing the suction holes provided in the support surface, outside the liquid ejecting area, and by providing no suction holes in the liquid ejecting area, it is possible to bring the recording medium into contact with the support surface over the entire liquid ejecting area. Accordingly, it is possible to minimize non-uniform temperature distribution in the recording medium in the liquid ejecting area.

The liquid ejecting apparatus of the invention may further include a heater that heats the recording medium to a predetermined temperature in the liquid ejecting area.

With this configuration, it is possible to heat the recording medium by the heater to a predetermined temperature in the liquid ejecting area to facilitate drying of the liquid landed on the recording medium. Furthermore, because there are no suction holes in the liquid ejecting area, the temperature management of the recording medium in the liquid ejecting area is easy.

In the liquid ejecting apparatus of the invention, the plurality of suction holes may include a first suction-hole row including suction holes arranged at predetermined intervals in a width direction perpendicular to a recording-medium transport direction on an upstream side of the liquid ejecting area in the recording-medium transport direction, and a second suction-hole row including suction holes arranged on a downstream side of the liquid ejecting area in the recording-medium transport direction so as to be aligned widthwise with the suction holes of the first suction-hole row.

With this configuration, tension is applied to the recording medium due to the suction from the first and second suction-hole rows arranged on the upstream side and downstream side, respectively, of the liquid ejecting area in the recording-medium transport direction. Thus, floating of the recording medium in the liquid ejecting area between the suction-hole rows can be prevented.

In the liquid ejecting apparatus of the invention, the plurality of suction holes may include a third suction-hole row including suction holes arranged at the predetermined intervals on the downstream side of the second suction-hole row in the recording-medium transport direction so as not to be aligned widthwise with the suction holes of the first suction-hole row.

With this configuration, because the suction holes of the third suction-hole row provided on the downstream side of the second suction-hole row in the recording-medium transport direction are not aligned widthwise with the suction holes of the first suction-hole row (second suction-hole row), suction may be applied to areas of the recording medium not subjected to the suction from the first and second suction-hole rows. Accordingly, it is possible to reliably prevent floating of the recording medium in the liquid ejecting area.

In the liquid ejecting apparatus of the invention, the suction holes of the third suction-hole row may be provided at positions corresponding to positions in the middle of adjacent suction holes of the first suction-hole row.

With this configuration, because the suction holes of the third suction-hole row and the suction holes of the first suction-hole row (second suction-hole row) are shifted by half pitch, it is possible to effectively minimize, by suction, floating of middle portions of the areas of the recording medium not subjected to the suction from the first and second suction-hole rows, i.e., peak portions of creases formed by floating.

The liquid ejecting apparatus of the invention may further include a carriage on which the liquid ejecting head is mounted, the carriage being moved in the width direction; and a projection provided on the carriage so as to project along a side surface, in the width direction, of the liquid ejecting head. The third suction-hole row is provided on the downstream side of the projections in the recording-medium transport direction.

With this configuration, that is, by providing the third suction-hole row on the downstream side of the projection in the recording-medium transport direction, it is possible to effectively minimize floating of the leading end of a curled recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
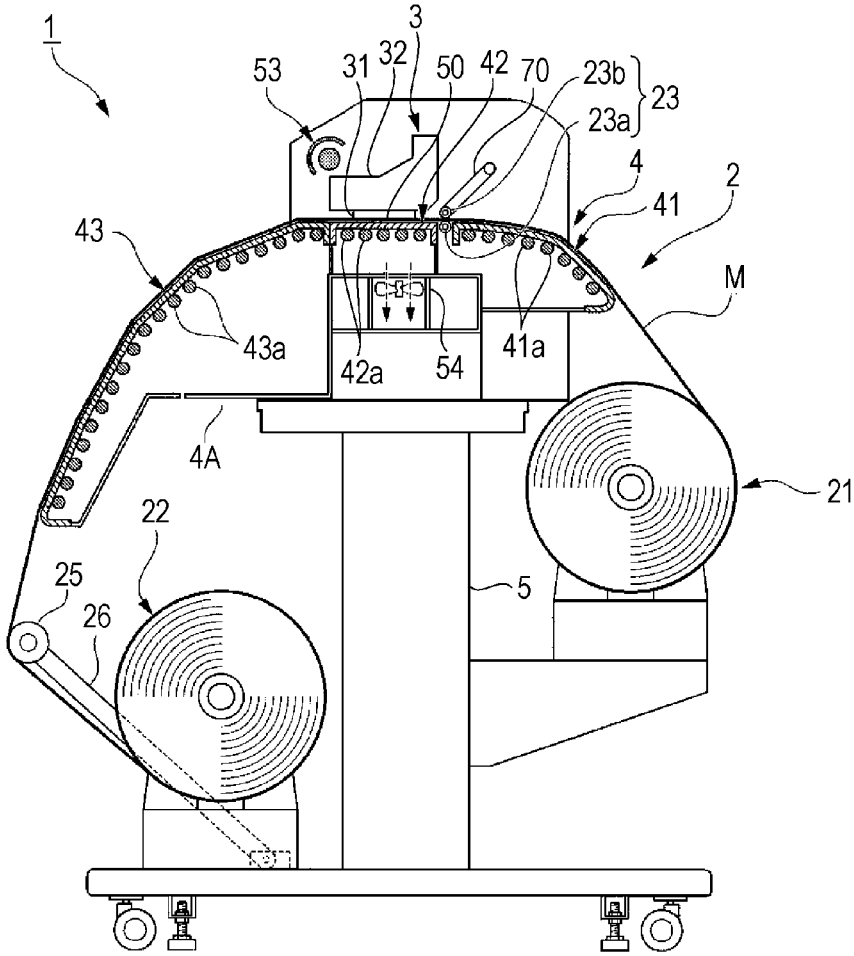
FIG. 1 illustrates the configuration of a printer according to an embodiment of the invention.

An embodiment of a liquid ejecting apparatus of the invention will be described below with reference to the drawings. Note that, for the sake of clarity, the respective members illustrated in the drawings referred to in the following description are not to scale. In this embodiment, an ink jet printer (hereinbelow, "printer") will be described as an example of the liquid ejecting apparatus of the invention.

FIG. 1 illustrates the configuration of a printer 1 according to an embodiment of the invention.

The printer 1 is a large format printer (LFP) that prints an image on a relatively large medium (recording medium) M. The medium M in this embodiment is, for example, a vinyl chloride film.

As illustrated in FIG. 1, the printer 1 includes a transport unit 2 that transports the medium M by a roll-to-roll method, a recording unit 3 that ejects ink (liquid) onto the medium M to form images or characters, and a recording-medium support unit 4 that supports and heats the medium M. These units are supported by a main-body frame 5.

The transport unit 2 includes a roller 21 that feeds the rolled medium M and a roller 22 that takes up the medium M fed from the roller 21. The transport unit 2 further includes a transport roller 23 that transports the medium M in a transport path extending between the rollers 21 and 22. The transport unit 2 further includes a tension roller 25 that applies tension to the medium M. The tension roller 25 is supported by a swing frame 26.

The recording unit 3 includes ink jet heads (liquid ejecting head) 31 that eject ink onto the medium M while being transported, and a carriage 32 that carries the ink jet heads 31 and reciprocates in a width direction (i.e., a direction perpendicular to the plane of the sheet in FIG. 1). The ink jet heads 31 have a plurality of nozzles and eject ink that is selected taking into consideration the compatibility with the medium M and that requires penetration drying or evaporation drying.

The recording-medium support unit 4 supports and heats the medium M to quickly dry and fix ink onto the medium M, thereby preventing ink bleed and blurring and improving the image quality. The recording-medium support unit 4 has a support surface that constitutes a part of a medium-transport path. The recording-medium support unit 4 supports the medium M in an upward convex shape and heats the medium M on the support surface. The recording-medium support unit 4 includes a support housing 4A, which defines the external shape thereof.

The recording-medium support unit 4 includes a preheater 41 that preheats the medium M on the upstream side of the recording unit 3 in the transport direction, a platen heater 42 that heats the medium M at a position facing the recording unit 3, and an after-heater 43 that heats the medium M on the downstream side of the recording unit 3 in the transport direction.

In this embodiment, the heating temperature of a heater 41*a* of the preheater 41 is set to 40° C. Furthermore, in this embodiment, the heating temperature of a heater 42*a* of the platen heater 42 is also set to 40° C. (target temperature). Furthermore, in this embodiment, the heating temperature of a heater 43*a* of the after-heater 43 is set to 50° C., which is higher than the heating temperature of the heaters 41*a* and 42*a*.

The preheater 41 gradually increases the temperature of the medium M from room temperature to a target temperature (the temperature at the platen heater 42) to facilitate drying of the ink after landing on the medium M.

Furthermore, the platen heater 42 maintains the medium M at the target temperature when the medium M receives ink to facilitate drying of the ink after landing on the medium M.

Furthermore, the after-heater 43 increases the temperature of the medium M to a temperature higher than the target temperature to quickly dry wet ink landed on the medium M, so that the ink landed on the medium M is completely dried and fixed to the medium M before the medium M is taken up by the roller 22.

Next, the characteristic configuration of the recording-medium support unit 4 according to this embodiment will be described.

Figure 2:
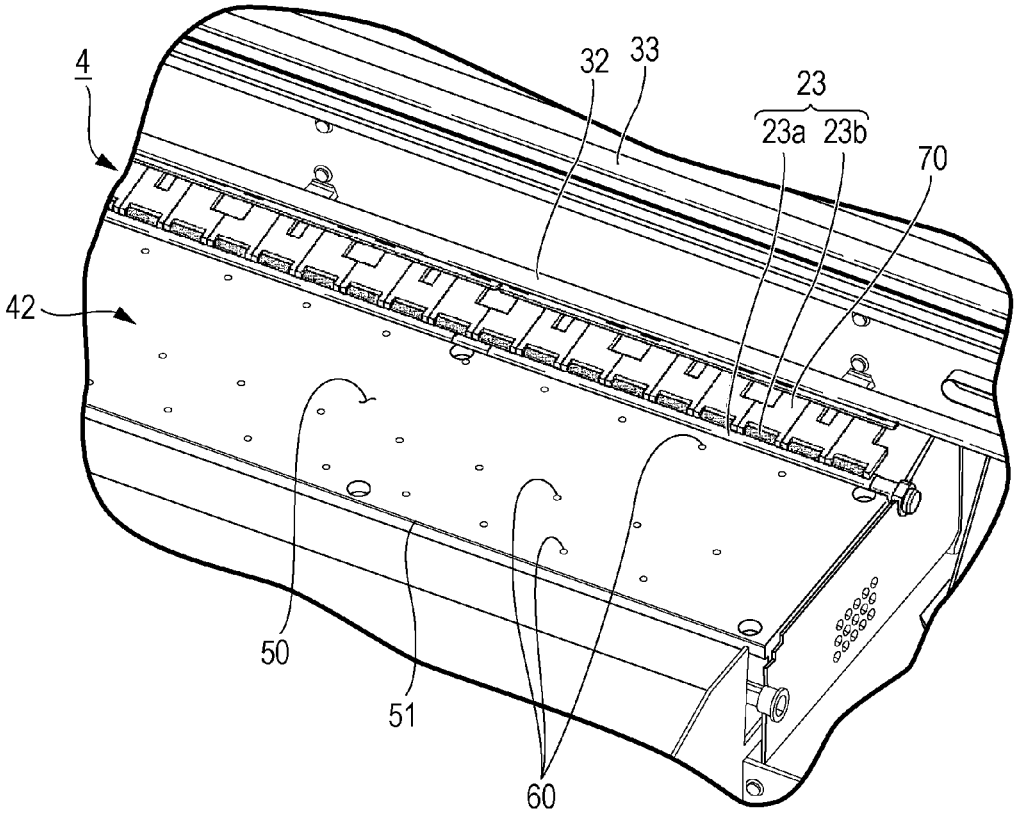
FIG. 2 is a perspective view of a recording-medium support unit according to the embodiment of the invention.

FIG. 2 is a perspective view of the recording-medium support unit 4 according to the embodiment of the invention. FIG. 2 illustrates the platen heater 42 and its vicinity in the recording-medium support unit 4.

As illustrated in FIG. 2, the platen heater 42 includes a support member 51 having a support surface 50 for supporting the medium M. The support member 51 is a flat metal plate extending in a width direction perpendicular to the medium-transport direction. The support member 51 is larger than the medium M in the width direction so as to be able to support the medium M in the width direction.

As illustrated in FIG. 1, the heater 42*a* is provided on a back surface of the support member 51, i.e., a surface opposite to the support surface 50 (opposite surface). The heater 42*a* is a tube heater and is attached to the back surface with an aluminum tape (not shown). Thus, the heater 42*a* heats the support member 51 from the back surface through thermal conduction and indirectly heats the back of the medium M supported on the support surface 50. The heaters 41*a* and 43*a* also have the same configuration and indirectly heat the back of the medium M.

An infrared heater 53 is provided at a position facing the support surface 50 of the support member 51. The infrared heater 53 is provided at a predetermined distance from the support surface 50 so as to extend in the width direction of the support member 51. Thus, the infrared heater 53 directly irradiates the support surface 50 with infrared energy to heat the support member 51 by radiation, and when the medium M is supported on the support surface 50, the infrared heater 53 directly heats the recording surface of the medium M by radiation.

The infrared heater 53 emits an electromagnetic wave having a wavelength of 2 μm to 4 μm at the main part of the peak of the radiation spectrum. With this configuration, the infrared heater 53 vibrates molecules of water contained in the ink and facilitates drying of ink by the frictional heat, without significantly increasing the temperature of the components therearound that do not contain the molecules of water. Accordingly, it is possible make the ink absorb most of the infrared energy to intensively heat the ink landed on the recording surface.

The transport roller 23 is provided on the upstream side of the platen heater 42 in the transport direction. The transport roller 23 includes a driving roller 23*a* and driven rollers 23*b*. The driving roller 23*a* is connected to a driving source, such as a motor (not shown), and is rotated under the control of a controller (not shown) to feed the medium M onto the support surface 50 of the platen heater 42. On the other hand, the driven rollers 23*b* are driven by the rotation of the driving roller 23*a*.

As illustrated in FIG. 2, the driven rollers 23*b* according to this embodiment are supported by holders 70. The holders 70 are provided side-by-side in the width direction perpendicular to the transport direction. The holders 70 can swing about a shaft extending in the width direction and urge the driven rollers 23*b* toward the driving rollers 23*a* by spring members (not shown).

Figure 3:
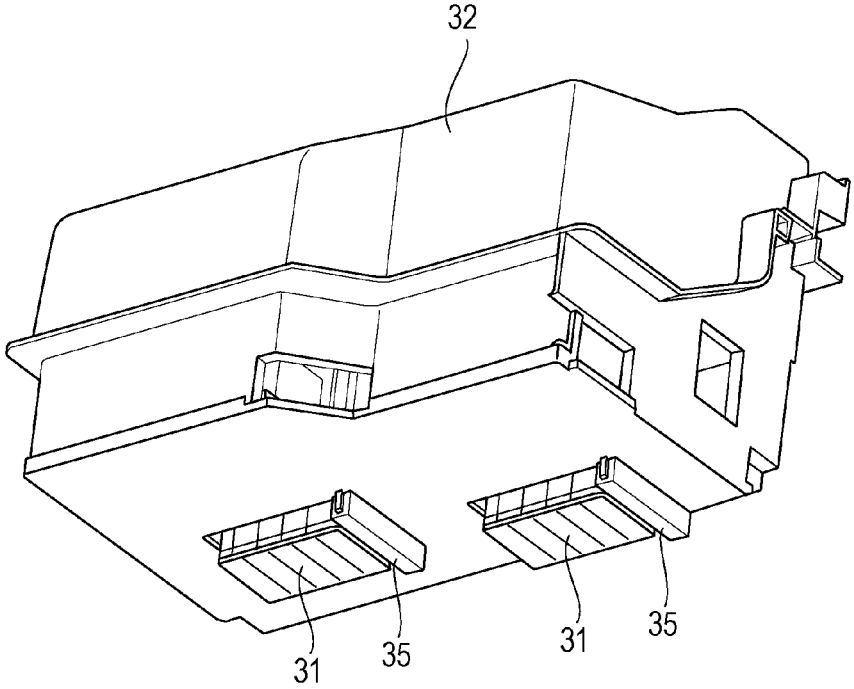
FIG. 3 is a perspective view, as viewed from below, of a carriage on which ink jet heads according to the embodiment of the invention are mounted.

FIG. 3 is a perspective view, as viewed from below, of the carriage 32 on which the ink jet heads 31 according to the embodiment of the invention are mounted.

The carriage 32 moves the ink jet heads 31, mounted thereon, over the support surface 50 in the width direction. The carriage 32 is guided in the width direction by a guide shaft 33 illustrated in FIG. 2. The carriage 32 in this embodiment carries two ink jet heads 31 and can eject ink with a predetermined width in the transport direction.

The carriage 32 according to this embodiment has sheet-separating guides (projections) 35 projecting along the side surfaces, in the width direction (scanning direction), of the ink jet heads 31. The sheet-separating guides 35 serve as walls extending in the scanning direction of the ink jet heads 31 to prevent contact between the nozzle surfaces of the ink jet heads 31 and the medium M. Furthermore, the sheet-separating guides 35 prevent the influence of an airflow generated by a scanning operation on ink droplets ejected from the ink jet heads 31.

The length by which the sheet-separating guides 35 protrude is 70% to 100% of the length by which the ink jet heads 31 protrude. Because the gap between the support surface 50 and the ink jet heads 31 is very small and is precisely controlled, if the length by which the sheet-separating guides 35 protrude is larger than the length by which the ink jet heads 31 protrude, the sheet-separating guides 35 may touch the medium M, causing paper jam etc. On the other hand, it is preferable that the length, in the transport direction, of the sheet-separating guides 35 be larger than that of the ink jet heads 31 so that it can cover the entire ink jet heads 31.

Referring back to FIG. 2, the support surface 50 has a plurality of suction holes 60. The suction holes 60 are through-holes provided in the support member 51. As illustrated in FIG. 1, a suction fan 54 is provided in the support housing 4A of the recording-medium support unit 4. The suction fan 54 creates negative pressure in the support housing 4A to draw the outside air from the suction holes 60 (not shown in FIG. 1), thereby bringing the medium M into tight contact with the support surface 50 and preventing floating of the medium M.

Figure 4:
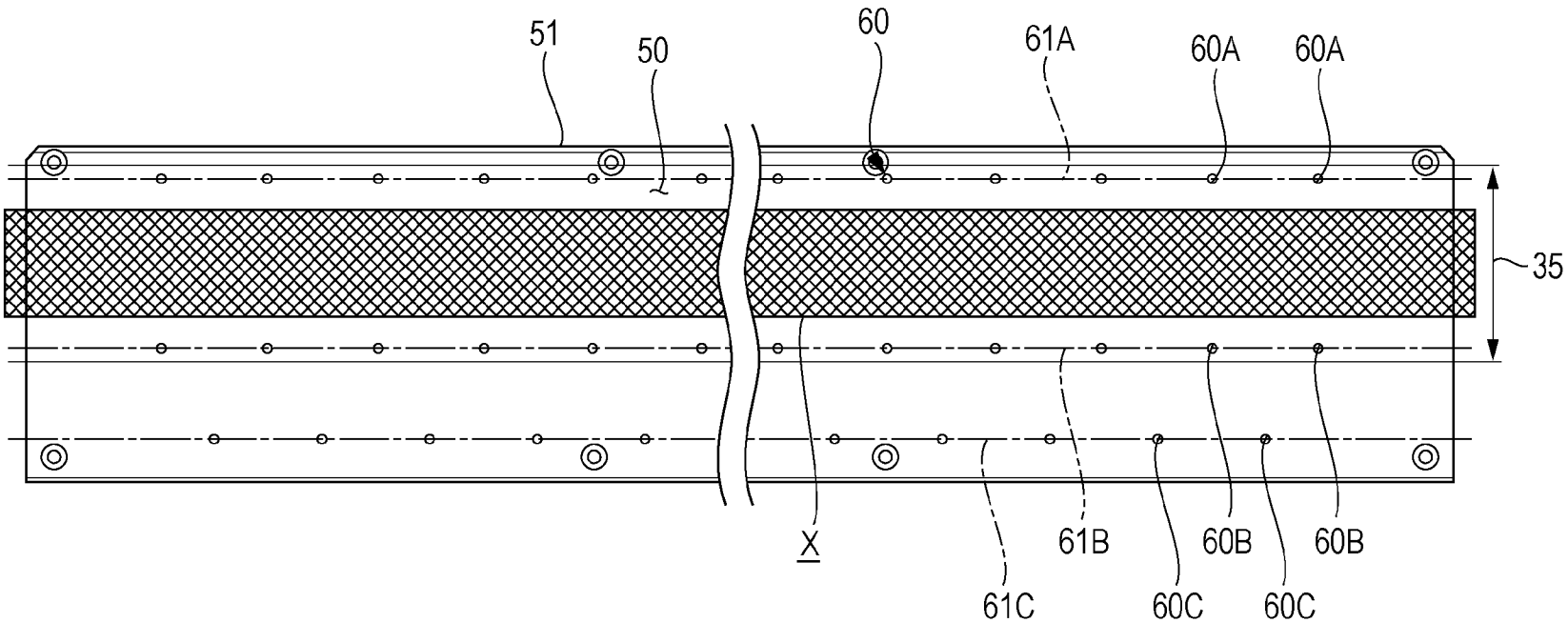
FIG. 4 is a plan view illustrating the arrangement of a plurality of suction holes provided in a support surface according to the embodiment of the invention.

FIG. 4 is a plan view illustrating the arrangement of the suction holes 60 provided in the support surface 50 according to the embodiment of the invention. Note that, in FIG. 4, the top-bottom direction corresponds to the transport direction, and the left-right direction corresponds to the width direction.

As illustrated in FIG. 4, a print area (liquid ejecting area) X in which ink is ejected from the ink jet heads 31 is defined in the support surface 50. The suction holes 60 provided in the support surface 50 are located outside the print area X in which ink is ejected.

The suction holes 60 in this embodiment include a first suction-hole row 61A, a second suction-hole row 61B, and a third suction-hole row 61C.

The first suction-hole row 61A includes suction holes 60A arranged at predetermined intervals in the width direction perpendicular to the transport direction, on the upstream side of the print area X in the medium-transport direction (the upper side in FIG. 4). Note that the intervals at which the suction holes 60A are provided in the width direction (predetermined intervals) are determined on the basis of the size, type, etc., of the medium M used in the printer 1.

The second suction-hole row 61B includes suction holes 60B arranged on the downstream side (the lower side in FIG. 4) of the print area X in the medium-transport direction so as to be aligned widthwise with (so as to have the same coordinates as) the suction holes 60A of the first suction-hole row 61A. The intervals at which the suction holes 60B are provided are equal to the intervals at which the suction holes 60A are provided. The suction holes 60B of the second suction-hole row 61B and the suction holes 60A of the first suction-hole row 61A make one-to-one correspondence in the transport direction with the print area X therebetween.

The third suction-hole row 61C includes suction holes 60C arranged at predetermined intervals on the downstream side of the second suction-hole row 61B in the transport direction so as not to be aligned widthwise with (i.e., so as not to have the same coordinates as) the suction holes 60A of the first suction-hole row 61A. That is, although the suction holes 60C are provided at the same intervals as the suction holes 60A (suction holes 60B), the suction holes 60C are shifted from the suction holes 60A (suction holes 60B) in the width direction.

The suction holes 60C of the third suction-hole row 61C are provided at positions corresponding to positions in the middle of the adjacent suction holes 60A of the first suction-hole row 61A. In this embodiment, the suction holes 60C of the third suction-hole row 61C and the suction holes 60A (suction holes 60B) of the first suction-hole row 61A (second suction-hole row 61B) are shifted by half pitch. Furthermore, the third suction-hole row 61C is provided on the downstream side, in the transport direction, of the sheet-separating guides 35 provided on the carriage 32.

Next, the operation of the thus-configured printer 1 according to this embodiment and the effect of the thus-configured suction holes 60 will be described.

When the medium M is transported to the print area X on the support surface 50, the ink jet heads 31 start printing. The recording-medium support unit 4 includes the heater 41*a* that heats the medium M on the support surface 50 to a predetermined temperature (in this embodiment, 40° C.) in the print area X, and the heater 42*a* that preheats the medium M on the upstream side thereof in the transport direction. In this embodiment, because the heaters 41*a* and 42*a* that can heat the medium M located in the print area X or located on the upstream side thereof in the transport direction are provided, it is possible to facilitate drying of ink landed on the medium M in the print area X.

As illustrated in FIG. 4, the support surface 50 has the suction holes 60 from which air is drawn. The medium M subjected to negative pressure is brought into tight contact with the support surface 50 and is prevented from floating. Accordingly, it is possible to maintain a constant distance between the medium M and the ink jet head print area X, and hence, to improve the image quality. Herein, the suction holes 60 provided in the support surface 50 are located outside the print area X in which ink is ejected. Because the suction holes 60 are not provided in the print area X, it is possible to eliminate non-contact portions where the medium M is not in contact with the support surface 50 (i.e., portions above the suction holes 60, i.e., spaces) in the print area X.

With this configuration, it is possible to bring the medium M into contact with the support surface 50 over the entire print area X and to minimize non-uniform temperature distribution in the medium M heated to a predetermined temperature in the print area X. Accordingly, variation of the evaporation rate of the ink solvent landed on the medium M in the print area X is eliminated, and drying of the ink solvent is substantially uniformly facilitated. As a result, a high-quality image (in which generation of an uneven image is prevented) can be obtained. Furthermore, because the suction holes 60 are not provided in the print area X, the influence of a decrease in temperature due to suction of the outside air on the medium M can be eliminated. Thus, the temperature management (temperature control) of the medium M in the print area X is easy.

Furthermore, the suction holes 60 according to this embodiment include the first suction-hole row 61A including the suction holes 60A arranged at predetermined intervals in the width direction perpendicular to the transport direction, on the upstream side of the print area X in the medium-transport direction, and the second suction-hole row 61B including the suction holes 60B arranged on the downstream side of the print area X in the medium-transport direction so as to be aligned widthwise with the suction holes 60A of the first suction-hole row 61A. With this configuration, tension is applied to the medium M due to the suction from the first suction-hole row 61A and the second suction-hole row 61B arranged on the upstream side and downstream side, respectively, of the print area X in the transport direction. Thus, floating of the medium M in the print area X between the suction-hole rows can be prevented.

The suction holes 60 according to this embodiment further include the third suction-hole row 61C including the suction holes 60C arranged at predetermined intervals on the downstream side of the second suction-hole row 61B in the transport direction so as not to be aligned widthwise with the suction holes 60A of the first suction-hole row 61A. With this configuration, suction may be applied to areas of the medium M not subjected to suction from the first suction-hole row 61A and the second suction-hole row 61B (i.e., areas between the suction holes 60A (suction holes 60B) in the width direction). Accordingly, floating of the medium M in the print area X can be reliably prevented.

Moreover, the suction holes 60C of the third suction-hole row 61C are provided at positions corresponding to positions in the middle of the adjacent suction holes 60A of the first suction-hole row 61A. With this configuration, because the suction holes 60C of the third suction-hole row 61C and the suction holes 60A (suction holes 60B) of the first suction-hole row 61A (second suction-hole row 61B) are shifted by half pitch, it is possible to effectively minimize, by suction, floating of middle portions of the areas of the medium M not subjected to the suction from the first suction-hole row 61A and the second suction-hole row 61B, i.e., portions that tend to become peaks of creases formed by floating of the medium M.

In addition, the third suction-hole row 61C is provided on the downstream side, in the transport direction, of the sheet-separating guides 35 provided on the carriage 32. On the other hand, the first suction-hole row 61A and the second suction-hole row 61B are provided within the width, in the transport direction, of the sheet-separating guides 35 provided on the carriage 32. In a medium M fed from a roller body, as in this embodiment, floating due to curls significantly appears at the leading end of the medium M. If the distance between the second suction-hole row 61B and the third suction-hole row 61C is small, it is difficult to effectively suppress floating of the leading end of the medium M, so a greater distance is preferred. Hence, in this embodiment, the third suction-hole row 61C is provided on the downstream side, in the transport direction, of the sheet-separating guides 35, which are used as the positional reference. With this configuration, it is possible to effectively minimize floating of the leading end of the medium M having curls.

According to this embodiment described above, the printer 1 includes the transport unit 2 that transports the medium M; the ink jet heads 31 that eject ink onto the medium M; and the recording-medium support unit 4 having the support surface 50 on which the medium M is supported, the support surface 50 having the suction holes 60 located outside the print area X in which ink is ejected. With this configuration, it is possible to prevent floating of the medium M and to minimize generation of an uneven image.

Although the preferred embodiment of the invention has been described with reference to the drawings, the invention is not limited to the above-described embodiment. The shapes and combinations of the components described in the above-described embodiment are just examples, and hence, they may be variously modified according to the design requirement etc., within a scope not departing from the spirit of the invention.

Furthermore, although the case where the liquid ejecting apparatus is the printer 1 has been described in the above-described embodiment, the liquid ejecting apparatus does not necessarily have to be a printer, but may be a copier or a facsimile machine.

Furthermore, a liquid ejecting apparatus that ejects liquid other than ink may be employed as the liquid ejecting apparatus. The invention may be applicable to various liquid ejecting apparatuses having a recording head that ejects a very small amount of droplets of liquid. Note that the term "droplets" refers to a state of liquid ejected from a liquid ejecting apparatus, and the droplets may have a particle shape, a tear drop shape, and a shape with a long tail. Furthermore, the term "liquid" as used herein refers to a material that can be ejected from a liquid ejecting apparatus. For example, any substance in its liquid phase may be used, and examples thereof include flowable materials, such as high-viscosity liquid, low-viscosity liquid, sol, gel water, other inorganic solvent, organic solvent, solution, liquid resin, and liquid metal (molten metal). Furthermore, not only liquid, which is one state of a substance, but also materials in which particles of a functional material composed of solid, such as colorant or metal particles, are dissolved or dispersed in a solvent may be used. A typical example of liquid is ink, as described in the embodiment above. Herein, "ink" includes various liquid compositions, such as typical water-based ink, oil-based ink, gel ink, and hot-melt ink. Furthermore, the recording media include paper, functional paper, substrates, and sheet metal, in addition to plastic films, such as vinyl chloride films.

The entire disclosure of Japanese Patent Application No. 2012-013070, filed Jan. 25, 2012 is expressly incorporated by reference herein.

What is claimed is:

1. A liquid ejecting apparatus comprising:

a transport unit that transports a recording medium;

a liquid ejecting head that ejects liquid onto the recording medium; and a recording-medium support unit having a support surface on which the recording medium is supported, the support surface having a plurality of suction holes, wherein the plurality of suction holes in the support surface are located outside a liquid ejecting area in which the liquid is ejected, and wherein the plurality of suction holes include a first suction-hole row including suction holes arranged at predetermined intervals in a width direction perpendicular to a recording-medium transport direction on an upstream side of the liquid ejecting area in the recording-medium transport direction, and a second suction-hole row including suction holes arranged on a downstream side of the liquid ejecting area in the recording-medium transport direction so as to be aligned widthwise with the suction holes of the first suction-hole row.

2. The liquid ejecting apparatus according to claim 1, further comprising a heater that heats the recording medium to a predetermined temperature in the liquid ejecting area.

3. The liquid ejecting apparatus according to claim 1, wherein the plurality of suction holes include a third suction-hole row including suction holes arranged at the predetermined intervals on the downstream side of the second suction-hole row in the recording-medium transport direction so as not to be aligned widthwise with the suction holes of the first suction-hole row.

4. The liquid ejecting apparatus according to claim 3, wherein the suction holes of the third suction-hole row are provided at positions corresponding to positions in the middle of adjacent suction holes of the first suction-hole row.

5. The liquid ejecting apparatus according to claim 3, further comprising:

a carriage on which the liquid ejecting head is mounted, the carriage being moved in the width direction; and a projection provided on the carriage so as to project along a side surface, in the width direction, of the liquid ejecting head, wherein the third suction-hole row is provided on the downstream side of the projections in the recording-medium transport direction.

* * * * *